US007186070B2

(12) United States Patent
Morris et al.

(10) Patent No.: US 7,186,070 B2
(45) Date of Patent: Mar. 6, 2007

(54) METHOD FOR MODIFYING GAS TURBINE NOZZLE AREA

(75) Inventors: Mark C. Morris, Phoenix, AZ (US); Thomas E. Strangman, Prescott, AZ (US); Craig A. Wilson, Mesa, AZ (US); George W. Wolfmeyer, Tempe, AZ (US); Steve H. Halfmann, Chandler, AZ (US); David K. Jan, Fountain Hills, AZ (US)

(73) Assignee: Honeywell International, Inc., Morristown, NJ (US)

( * ) Notice: Subject to any disclaimer, the term of this patent is extended or adjusted under 35 U.S.C. 154(b) by 143 days.

(21) Appl. No.: 10/963,185

(22) Filed: Oct. 12, 2004

(65) Prior Publication Data

US 2006/0078422 A1 Apr. 13, 2006

(51) Int. Cl.
*F04D 29/40* (2006.01)

(52) U.S. Cl. ..... 415/1; 29/889.22

(58) Field of Classification Search ..... 415/1, 415/151, 156, 217.1; 416/241 R; 29/889.22, 29/889.23

See application file for complete search history.

(56) References Cited

U.S. PATENT DOCUMENTS

| | | | | |
|---|---|---|---|---|
| 4,827,588 | A | 5/1989 | Meyer | |
| 5,073,433 | A | 12/1991 | Taylor | |
| 5,636,439 | A | 6/1997 | Cunha et al. | |
| 5,723,078 | A * | 3/1998 | Nagaraj et al. | 264/36.18 |
| 6,321,448 | B1 | 11/2001 | Makino et al. | |
| 6,388,223 | B2 | 5/2002 | Jones et al. | |
| 6,416,278 | B1 | 7/2002 | Caddell, Jr. et al. | |
| 6,418,618 | B1 * | 7/2002 | Burdgick | 29/889 |
| 6,482,537 | B1 | 11/2002 | Strangman et al. | |
| 6,736,595 | B2 | 5/2004 | Jinnai et al. | |

* cited by examiner

*Primary Examiner*—Edward K. Look
*Assistant Examiner*—Dwayne J White
(74) *Attorney, Agent, or Firm*—Ingrassia Fisher & Lorenz

(57) ABSTRACT

A method of modifying a turbine nozzle area comprises depositing a thermal barrier coating (TBC) on the nozzle endwalls to provide a minimum nozzle area, evaluating an airflow through the nozzle, and machining the TBC to increase the nozzle area. Adjacent segment area variation may be minimized, improving engine reliability by reducing the aerodynamic excitation to the down stream blade.

38 Claims, 4 Drawing Sheets

METHOD FOR MODIFYING GAS TURBINE NOZZLE AREA

GOVERNMENT INTERESTS

The invention was made with Government support under contract number DAAJ02-94-C-0030 awarded by the United States Army. The Government has certain rights in this invention.

BACKGROUND OF THE INVENTION

The present invention generally relates to gas turbine engines and, more particularly, to turbine nozzles.

A gas turbine engine includes a compressor, a combustor, and a turbine. The compressor provides compressed air to the combustor. The combustor mixes the compressed air with fuel, ignites the mixture, and provides combustion gases to the turbine. The turbine extracts energy from the combustion gases.

The turbine includes one or more stages with each stage having an annular turbine nozzle and a plurality of rotor blades. The turbine nozzle channels the combustion gases to the rotor blades and the rotor blades extract energy from the combustion gases.

The turbine nozzle comprises a plurality of circumferentially spaced stator vanes positioned between and attached to radially inner and outer bands (endwalls). The circumferentially spaced vanes define converging channels there between through which the combustion gases are turned and accelerated toward the rotor blades.

Cooled turbine nozzle castings are typically one of the critical path components in gas turbine engine fabrication. In engine development programs, the first engine to test date is limited by the long schedule required to fabricate the cooled high pressure turbine (HPT) blade and nozzle parts. Due to the expensive tooling and fabrication cost of the cooled nozzle, limited quantities of hardware are purchased for development programs. A critical engine design parameter is the minimum flow area of the nozzle (nozzle area), which affects the operating efficiency of the turbine and the entire engine. After engine testing, it is often discovered that the nozzle area requirement to match the engine as a system (for optimal performance) is different than the nozzle area purchased. Thus, additional hardware must be purchased to match the engine for optimal performance.

When multiple nozzle area class sizes are purchased for program "risk mitigation", several classes do not get utilized because they are not the needed size class at the end of the program. This is a waste of expensive hardware, tooling, and sometimes program cycle time. In some cases, the program does not have additional hardware assets (due to cost constraints) to achieve optimal engine matching of turbine nozzle areas, resulting in a specific fuel consumption increase in the "as tested" demonstrator. This can be a significant customer satisfaction issue when, for example, the specific fuel consumption increase is 2% or more.

Due to the critical nature of the nozzle area and the expense of the hardware, methods of modifying the nozzle area have been described. Many of the disclosed methods utilize some form of "airfoil rotation" to adjust the nozzle area. Known designs include rotating the entire vane, rotating just the aft portion of the vane, rotating all the vanes, and rotating just some of the vanes. These techniques have required rotational attachment apparatus and actuation mechanisms for rotating the vanes or just their aft ends. Known attachment apparatus include a shaft connected to the vane and moveably attached to an actuation mechanism. For example, U.S. Pat. No. 6,736,595 describes the use of airfoil rotation in conjunction with lever plates to modify the nozzle area. In this method, the vanes are connected to coupling shafts, which in turn are connected to link plates. The link plates are movably connected to a lever plate. Moving the link plates relative to the lever plate rotates the vanes. Although this method may be used to modify the nozzle area, performance of the engine may be decreased because the optimal vector diagram to the blade is not maintained. Performance degradation may also occur due to leakages between the airfoils and endwalls. Additionally, this method does not address the problems associated with channel variation which will occur in the airfoils, endwall, and rotation linkage mechanisms. Furthermore, this method of adjusting airflow is not viable for integral airfoil and endwall assemblies when superalloys airfoils are coated with thermal barrier coatings or when the nozzle is fabricated with ceramic airfoils and endwalls.

In some turbine nozzle manufacturing methods, each of the vanes and endwalls is separately manufactured and, therefore, subject to inherent manufacturing tolerances. These tolerances are additive and "stack-up" during assembly of the nozzle, which can result in throat area variation. Variations in throat area between adjacent vanes can provide undesirable aero-mechanical excitation pressure forces which may lead to undesirable vibration of the rotor blades disposed downstream from the nozzle. This in turn can lead to engine performance and life reductions.

As can be seen, there is a need for improved methods of modifying nozzle area. Further, methods are needed wherein hardware expense can be reduced while optimal vector diagram to the blade can be maintained. Additionally, methods of reducing variation in throat area are needed.

SUMMARY OF THE INVENTION

In one aspect of the present invention, a method of modifying a nozzle area for a turbine nozzle comprises the steps of depositing a thermal barrier coating on at least one endwall of the turbine nozzle such that an initial nozzle area is produced; and modifying the thermal barrier coating such that the initial nozzle area is adjusted to provide a first nozzle area.

In another aspect of the present invention, a method of modifying a nozzle area for a turbine nozzle comprises the steps of depositing a first thermal barrier coating on a radially inward side of a nozzle outer endwall of the turbine nozzle; depositing a second thermal barrier coating on a radially outward side of a nozzle inner endwall of the turbine nozzle, such that an initial nozzle area is produced; and machining at least one of the first thermal barrier coating and the second thermal barrier coating such that the initial nozzle area is adjusted to provide a first nozzle.

In still another aspect of the present invention, a method of modifying a nozzle area comprises the steps of providing a turbine nozzle having a thermal barrier coating deposited on at least one endwall; and machining the thermal barrier coating such that the nozzle area is increased.

In yet another aspect of the present invention, a method of modifying a nozzle area for a turbine nozzle comprises the step of modifying a thermal barrier coating of at least one endwall of the turbine nozzle.

In another aspect of the present invention, a method of modifying a nozzle area for a turbine nozzle comprises the steps of depositing a first thermal barrier coating on a radially inward side of a nozzle outer endwall of the turbine nozzle, the step of depositing to a thickness between about 0.02 inches and about 0.10 inches, the thermal barrier coating selected from the group consisting of tetragonal zirconia stabilized with about 7% to about 8% by weight yttria and cubic zirconia stabilized with about 15% to about 30% by weight yttria; depositing a second thermal barrier coating on a radially outward side of a nozzle inner endwall of the turbine nozzle, the step of depositing to a thickness between about 0.02 inches and about 0.10 inches, the thermal barrier coating selected from the group consisting of tetragonal zirconia stabilized with about 7% to about 8% by weight yttria and cubic zirconia stabilized with about 15% to about 30% by weight yttria; brazing a radially outward end of at least one nozzle vane to the radially inward side; brazing a radially inward end of at least one nozzle vane to the radially outward side; and machining the first thermal barrier coating and the second thermal barrier coating such that an increased nozzle area is produced.

In a further aspect of the present invention, a turbine nozzle comprises a nozzle inner endwall; a nozzle outer endwall positioned radially outward from the nozzle inner endwall, wherein at least one of the nozzle inner endwall and the nozzle outer endwall has a thermal barrier coating capable of being machined such that a nozzle area of the turbine nozzle is increased; and at least one nozzle vane positioned radially outward from the nozzle inner endwall and positioned radially inward from the nozzle outer endwall.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides methods for modifying gas turbine nozzle areas. The methods according to the present invention may find beneficial use in many industries including aerospace, automotive, and electricity generation. The present invention may be beneficial in applications including auxiliary power units (APU), turboshaft, turboprop, turbofan, automotive turbochargers, and military-based ground power. This invention may be useful in any gas turbine engine application.

In one embodiment, the present invention provides a method for modifying a gas turbine nozzle area. The method may comprise coating the endwalls of the nozzle with a thick thermal barrier coating (TBC) layer, machining the nozzle endwall TBC thickness to the minimum nozzle area that the engine program expects to require, evaluating engine performance, and increasing the nozzle area by machining the endwall TBC in the throat and trailing edge regions of the nozzle to open the effective flow area to an optimal value. Unlike the prior art "airfoil rotation" method, the present invention can modify the nozzle area while maintaining the optimal vector diagram to the blade, which can enhance engine performance. Further unlike the prior art, the nozzle area can be adjusted without the need for additional hardware. Moreover, machining of the endwall TBC allows the opportunity to minimize throat area variation.

Figure 1:
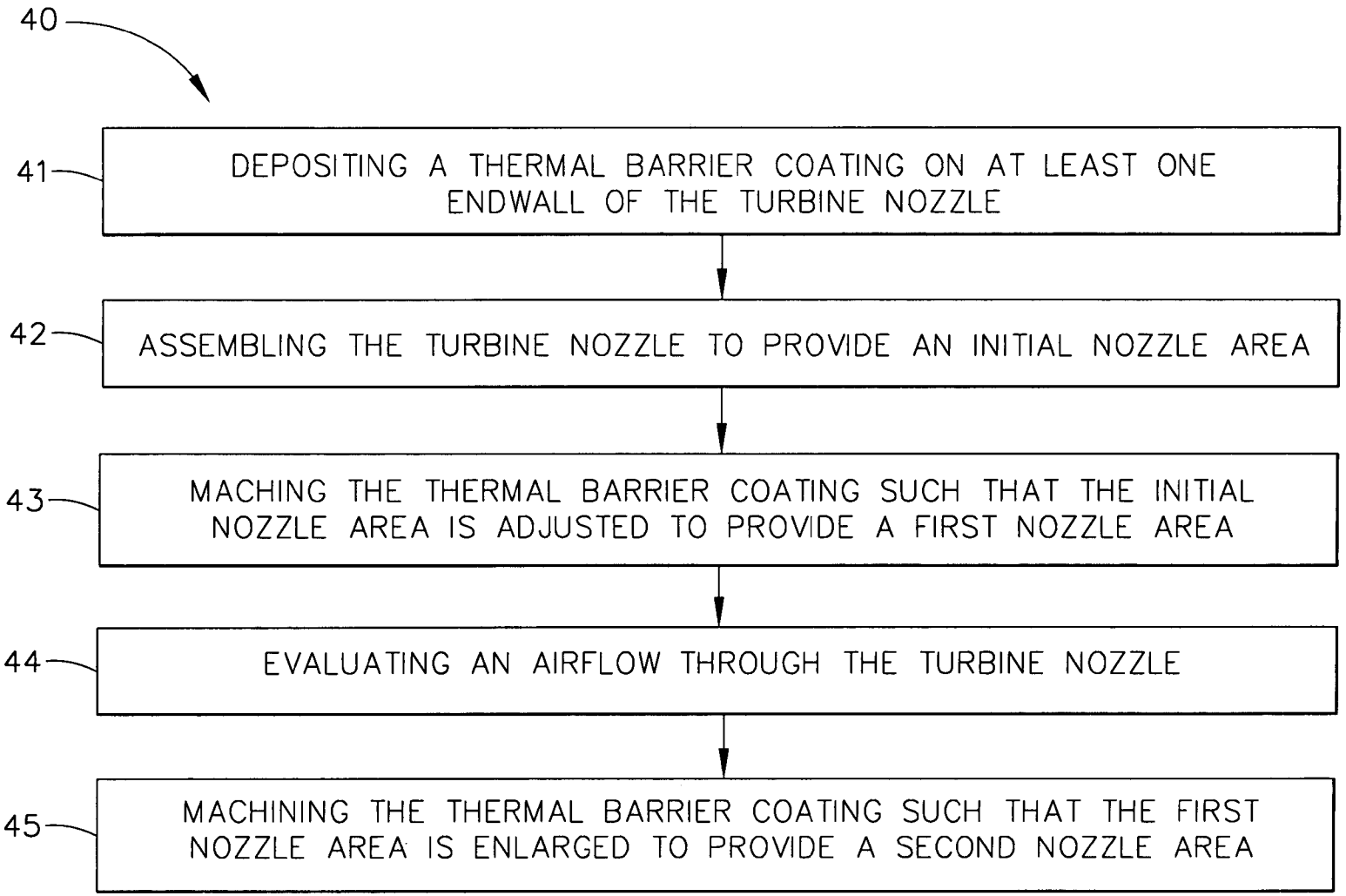
FIG. 1 is a flow chart of a method of modifying a turbine nozzle area according to an embodiment of the present invention.

A method 40 of modifying a nozzle area of a turbine nozzle is depicted in FIG. 1. The method may comprise a step 41 of depositing a TBC on at least one endwall of the turbine nozzle, a step 42 of assembling the turbine nozzle to provide an initial nozzle area, a step 43 of machining the TBC such that the initial nozzle area is adjusted to provide a first nozzle area, a step 44 of evaluating an airflow through the turbine nozzle, and a step 45 of machining the TBC such that the first nozzle area is enlarged to provide a second nozzle area.

Figure 2A:
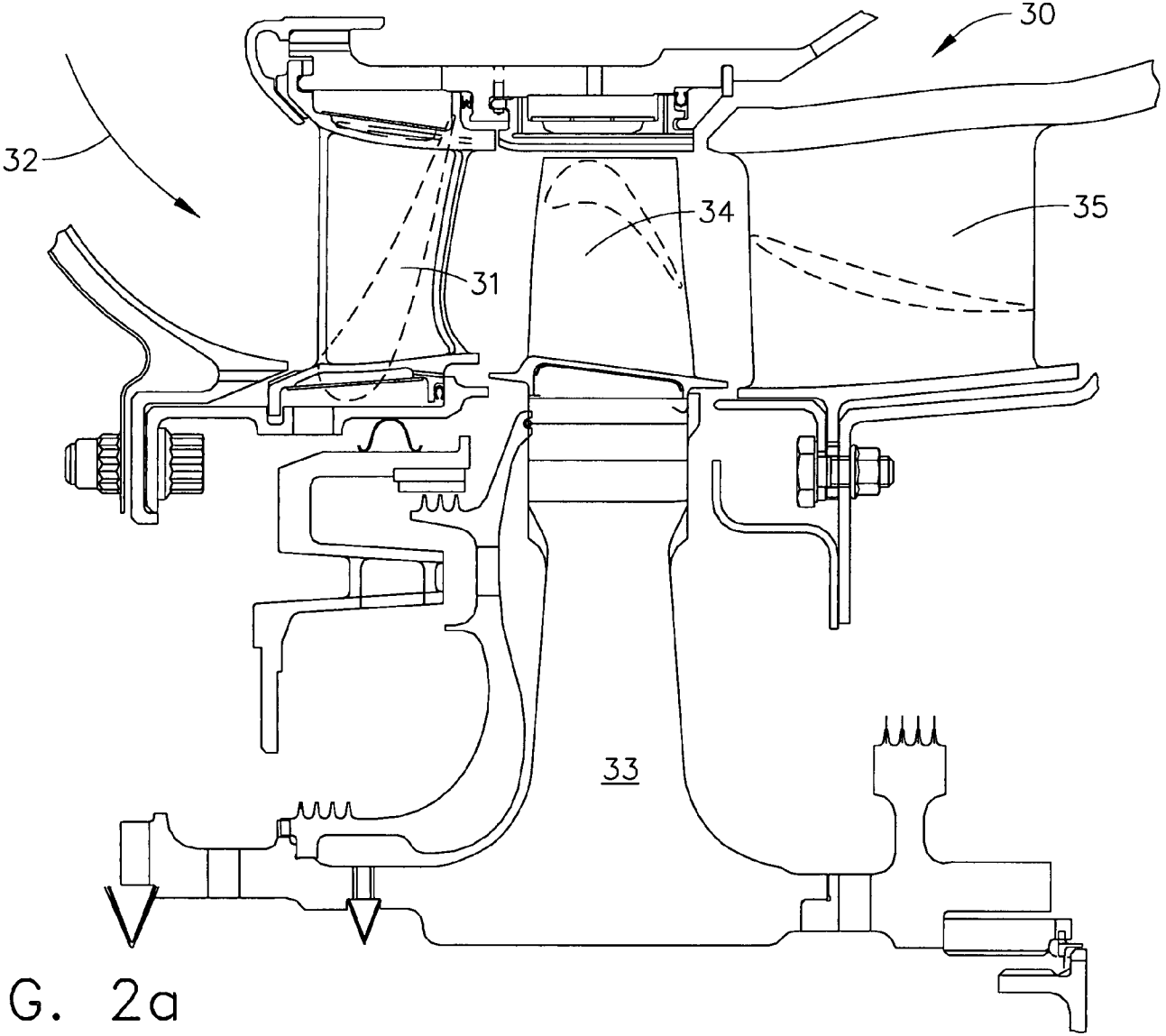
FIG. 2*a* is a cross-sectional view of a high pressure turbine module according to one embodiment of the present invention.

A high pressure turbine (HPT) module 30 is depicted in FIG. 2*a*. The turbine nozzle, such as but not limited to an HPT nozzle 31, may comprise any nozzle exposed to high temperatures. The nozzle may comprise materials such as nickel-base superalloy, cobalt-base superalloy, structural ceramic, silicon nitride and silicon carbide. A combustor gas flow 32 may pass through the HPT nozzle 31 from an upstream combustor (not shown) to a downstream HPT rotor 33. Energy may be extracted from the combustor gas flow 32 by the HPT blades 34 of the HPT rotor 33. The combustor gas flow 32 may then flow downstream to a low pressure turbine (LPT) nozzle 35.

Figure 2B:
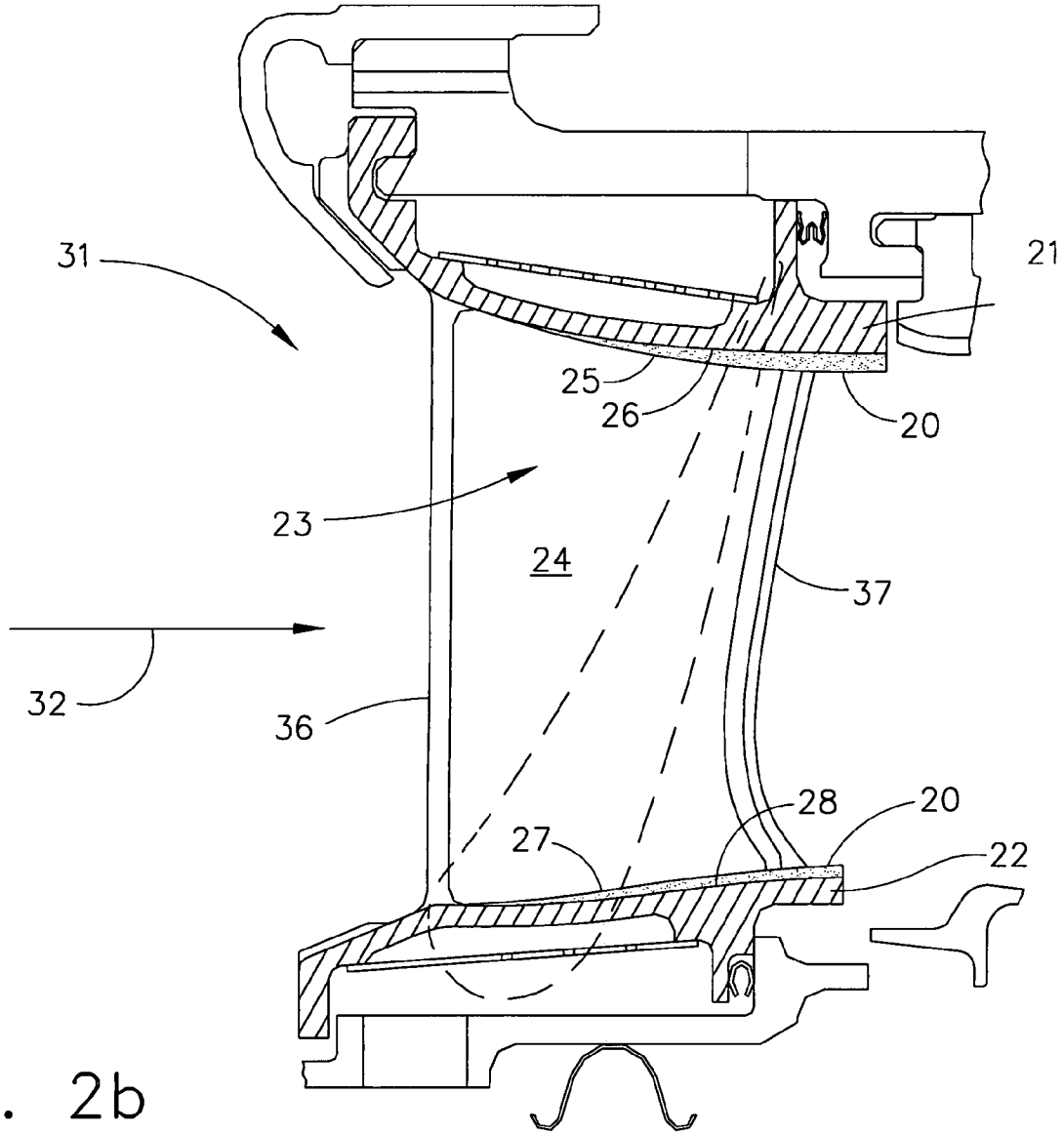
FIG. 2*b* is a close-up view of the turbine nozzle of FIG. 2*a*.

The HPT nozzle 31 may comprise two endwalls, a nozzle outer endwall 21 and a nozzle inner endwall 22, as better seen in FIG. 2*b*. The endwalls 21 and 22 may be annular in shape and positioned such that they are capable of supporting a plurality of circumferentially spaced nozzle vanes 23. For some applications, the nozzle outer endwall 21 and the nozzle inner endwall 22 may be segmented to relieve thermal stresses during engine operation. Each nozzle vane 23 may comprise a radially outward end 25 and a radially inward end 27. The radially outward end 25 may be in contact with a radially inward side 26 of the nozzle outer endwall 21. The radially inward end 27 may be in contact with a radially outward side 28 of the nozzle inner endwall 22. The circumferentially spaced nozzle vanes 23, along with the endwalls 21 and 22, may define a plurality of nozzle openings 24 through which the combustor gas flow 32 may be turned and accelerated toward the HPT blades 34.

Figure 3:
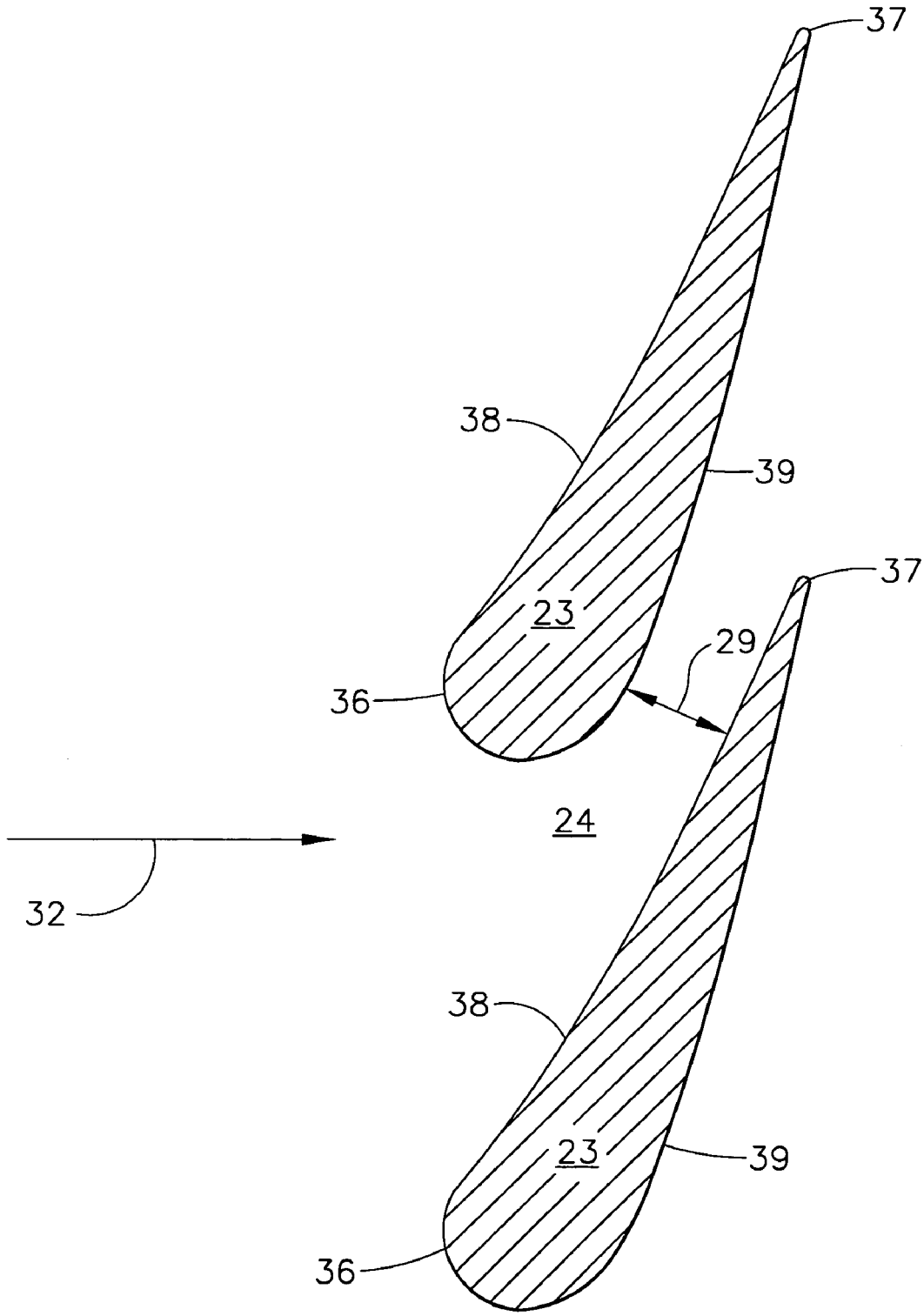
FIG. 3 is a plan view of two adjacent nozzle vanes according to one embodiment of the present invention.

A nozzle opening 24 may be a volume defined by adjacent nozzle vanes 23, a nozzle outer endwall 21 and a nozzle inner endwall 22. The nozzle opening 24 may have a minimum flow area, which is defined by the throat 29 and the radial height of the channel (separation between the gas-path surfaces of the thermal barrier coated endwalls 21 and 22 at the throat 29), for channeling the combustor gas flow 32, as depicted in FIG. 3. For example, each nozzle vane 23 may have an airfoil cross-section with a leading edge 36, a trailing edge 37, and pressure (concave) and suction (convex) sides, 38 and 39 respectively, there between. In this example, the trailing edge 37 of one nozzle vane 23 may be spaced from the suction side 39 of an adjacent nozzle vane 23 between its leading edge 36 and trailing edge 37 to define a throat 29 for the combustor gas flow 32 channeled between adjacent nozzle vanes 23. Adjacent ones of the nozzle vanes 23 define individual nozzle openings 24, each having a minimum flow area. Collectively the minimum flow areas of the nozzle openings 24 define the nozzle area. In other words, the nozzle area may be a minimum flow area through the turbine nozzle.

The step 41 of depositing a TBC 20 may comprise depositing a TBC 20 on the radially inward side 26 of the nozzle outer endwall 21. The step 41 of depositing a TBC 20 may comprise depositing a TBC 20 on the radially outward side 28 of the nozzle inner endwall 22. The step 41 of depositing a TBC 20 may comprise depositing by known techniques, such as plasma spray and electron beam-physical vapor deposition (EB-PVD). Methods of depositing TBC 20 are described in U.S. Pat. No. 5,073,433 (plasma spray) and U.S. Pat. No. 6,482,537 (EB-PVD), both of which are incorporated herein by reference. The TBC 20 may be deposited to a thickness of at least about 0.02 inches. For some applications the TBC 20 may be deposited to thicknesses between about 0.02 inches and about 0.10 inches. The thickness of the deposited TBC 20 may be such that the TBC 20 can be machined to increase the nozzle area. The thickness of the TBC 20 may be such that machining the TBC 20 can provide the minimum and maximum nozzle areas that an engine program expects to require. For some brazed segment applications, the TBC layer may be sprayed thicker than the original design intent to provide a smaller nozzle area prior to brazing of the segment. For a full ring fabrication design, the inner and outer cast rings can be TBC coated prior to brazing of the nozzle vanes 23 to the endwalls 21 and 22.

The TBC 20 of step 41 may comprise a thermal-insulating ceramic material. The TBC 20 may comprise a stabilized zirconia, such as yttria-stabilized zirconia (YSZ). The TBC 20 may comprise cubic zirconia stabilized with about 15% to about 30% by weight yttria. The TBC 20 may comprise tetragonal zirconia stabilized with about 7% to about 8% by weight yttria. Useful TBCs 20 may include stabilized hafnia and stabilized zirconia. The TBC 20 may comprise stabilizing oxides other than yttria, such as calcia, ceria, gadolinia, magnesia, neodymia, samaria, scandia, tantala, and ytterbia. A bond coat may be applied prior to depositing the TBC 20 to improve TBC adhesion, as is known in the art. The bond coat may include oxidation-resistant coatings and diffusion coatings.

The step 42 of assembling the turbine nozzle may comprise brazing the nozzle vanes 23 to the nozzle outer endwall 21 and to the nozzle inner endwall 22. For brazed segment applications, the step 42 may comprise brazing the endwalls 21 and 22 to the nozzle vanes 23 to produce a segment and assembling the segments into an engine for testing. For full ring design applications, an integrally cast nozzle may be employed, or a brazed assembly may be employed by separately casting the nozzle outer and inner endwalls 21 and 22. The nozzle vanes 23 may be cast to the nozzle outer endwall 21, or to the nozzle inner endwall 22, or to both of the endwalls, or to neither of the endwalls. After application of TBC 20 to the endwall surfaces, the nozzle vanes 23 may be brazed to the endwalls to produce a full ring. The TBC 20 may be deposited such that the nozzle vanes 23 may be brazed to the endwalls 21 and 22. For example, the areas to be brazed may be masked prior to TBC application and/or cleaned prior to brazing. The method used to provide suitable brazing surfaces may depend on manufacturing preference and application. The step 42 may provide an initial nozzle area.

The step 43 of machining the TBC such that the initial nozzle area is adjusted to provide a first nozzle area may comprise conventional machining and grinding techniques for ceramic materials. For some applications, the TBC may be modified without the use of power-operated machines to provide the first nozzle area. For example, the TBC may be modified by manual grinding to provide the first nozzle area. The step 43 may enlarge the initial nozzle area to provide the first nozzle area. Alternatively, the step 43 may smooth the TBC to provide more aerodynamic surfaces without also increasing the minimum flow area of the turbine nozzle. The minimum flow area of the initial nozzle area may be about equal to the minimum flow area of the first nozzle area for some applications. The minimum flow areas of the nozzle openings 24 may be machined such that they are about equal to one another. In other words, the step 43 may provide a reduction in nozzle opening variation. Nozzle opening variation may be the variation between the minimum flow areas of the nozzle openings 24. Useful techniques may include grinding with diamond tooling, borozon tooling, or carbide tooling. In some cases, single point machining of the TBC may be appropriate. Machining with diamond tooling may also be referred to as diamond grinding. The step 43 may comprise a lubricant for some applications. The grinding technique and lubricant may depend on manufacturing preference and application. The step 43 may be performed before or after the step 42 of assembling. For some applications, performing the step 43 prior to brazing the nozzle vanes 23 may reduce labor. The step 43 of machining may be accomplished in such a way as to provide a smooth transition along the endwall surface to minimize aerodynamic disturbances along the endwall surfaces. The first nozzle area may be the minimum nozzle area that the engine program expects to require.

The step 44 of evaluating an airflow through the turbine nozzle may comprise a cold flow fixture to calibrate the airflow. For some applications, the step 44 may be performed prior to brazing the nozzle vanes 23. The nozzle area requirement to match the engine as a system for optimal engine performance can be determined by known methods. The nozzle area requirement may depend on the application, combustor configuration, and turbine configuration. After engine performance evaluation, the nozzle area can be modified.

The step 45 of machining the TBC such that the first nozzle area is enlarged to provide a second nozzle area may comprise machining the TBC on at least one endwall. Engine performance diagnostics may be performed on the engine to determine the proper matching of the engine components. The nozzle endwalls 21 and 22 may then be machined to provide the desired nozzle area for optimal engine performance by enlarging the radial height of the channel (nozzle openings 24). Machining of the endwalls 21 and 22 may be accomplished in such a way as to provide a smooth transition along the endwall surface to minimize aerodynamic disturbances along the endwall surfaces. The first nozzle area, provided by step 43, can be increased by simply machining the TBC in the throat and trailing edge regions of the nozzle to open the effective flow area to provide a second nozzle area. The step 45 may be repeated to obtain larger nozzle areas, for example, third or fourth nozzle areas. The step 45 of machining may be such that a variation in throat area between adjacent vanes is reduced. The minimum flow areas of the nozzle openings 24 may be machined such that they are about equal to one another. In other words, the step 45 may provide a reduction in nozzle opening variation.

As can be appreciated by those skilled in the art, the present invention provides a cost reduction method to adjust turbine nozzle area without requiring long lead times or the purchasing of additional tooling and hardware. This may result in development program cycle time and cost reductions. The present invention provides a simple means to modify nozzle area to achieve optimal engine performance without requiring multiple classes of nozzles with different nozzle areas. Another benefit of this method is that cycle time and hardware requirements are reduced. The parts may be machined to the "as needed" area without inventory accumulation of non-needed parts. In addition, parts may be reworked to allow full utilization of program hardware. Moreover, for designs that may have HPT blade vibration concerns, this method provides a minimum discontinuity of nozzle area between adjacent nozzle openings. A large discontinuity of area between adjacent nozzle openings can be avoided which in turn reduces the aerodynamic excitations that result in HPT blade high cycle fatigue failures. This invention allows the opportunity to minimize the adjacent nozzle opening area variation, which improves reliability by reducing the aerodynamic excitation to the down stream blade. Another advantage of this method over the traditional "airfoil rotation" method is that the performance of the engine may be enhanced by maintaining the optimal vector diagram to the blade. Nevertheless, this invention may be used in conjunction with airfoil rotation techniques to achieve the optimal configuration for the engine. This invention also has the benefit of allowing the TBC as a durability enhancement for nozzle endwall thermal management.

The preceding discussion was focussed on turbine vanes and endwalls that are comprised of nickel- or cobalt-based superalloy structural materials. However, the method is also equally applicable to nozzles comprised of silicon nitride or silicon carbide vanes and endwalls.

It should be understood, of course, that the foregoing relates to exemplary embodiments of the invention and that modifications may be made without departing from the spirit and scope of the invention as set forth in the following claims.

We claim:

1. A method of modifying a flow area of a turbine nozzle through which a combustor gas flow passes, the method comprising the steps of:

depositing a thermal barrier coating on at least one endwall of said turbine nozzle such that an initial nozzle flow area is produced; and modifying said thermal barrier coating such that said initial nozzle flow area is adjusted to provide a first nozzle flow area.

2. The method of claim 1, further comprising the steps of:

evaluating an airflow through said turbine nozzle; and machining said thermal barrier coating such that said first nozzle flow area is enlarged to provide a second nozzle flow area.

3. The method of claim 1, wherein said step of depositing comprises depositing to a thickness of at least about 0.02 inches.

4. The method of claim 1, wherein said step of depositing comprises depositing to a thickness between about 0.02 inches and about 0.10 inches.

5. The method of claim 1, wherein said step of modifying the thermal barrier coating comprises machining with diamond tooling.

6. The method of claim 1, wherein said thermal barrier coating comprises a cubic zirconia stabilized with about 15% to about 30% by weight yttria.

7. The method of claim 1, wherein said thermal barrier coating comprises a tetragonal zirconia stabilized with about 7% to about 8% by weight yttria.

8. The method of claim 1, wherein said thermal barrier coating is selected from the group consisting of stabilized zirconia and stabilized hafnia.

9. The method of claim 1, wherein said step of depositing comprises plasma spraying.

10. The methods of claim 1, wherein said step of depositing comprises electron beam physical vapor depositing.

11. The method of claim 1, wherein said turbine nozzle comprises a plurality of nozzle openings and said step of modifying provides a reduction in nozzle opening variation.

12. A method of modifying a flow area of a turbine nozzle through which a combustor gas flow passes the method comprising the steps of:

depositing a first thermal barrier coating on a radially inward side of a nozzle outer endwall of said turbine nozzle;

depositing a second thermal barrier coating on a radially outward side of a nozzle inner endwall of said turbine nozzle, such that an initial nozzle flow area is produced; and machining at least one of said first thermal barrier coating and said second thermal barrier coating such that said initial nozzle flow area is adjusted to provide a first nozzle flow area.

13. The method of claim 12, further comprising the step of evaluating an airflow through said first nozzle flow area.

14. The method of claim 13, further comprising the step of machining at least one of said first thermal barrier coating and said second thermal barrier coating such that a second nozzle flaw area is produced, said second nozzle flow area is greater than said first nozzle flow area.

15. The method of claim 14, further comprising the step of machining at least one of said first thermal barrier coating and said second thermal barrier coating such that a third nozzle flow area is produced, said third nozzle flow area is greater than said second nozzle flow area.

16. The method of claim 12, further comprising the step of brazing a radially inward end of at least one nozzle vane to said radially outward side.

17. The method of claim 12, further comprising the step of brazing a radially outward end of at least one nozzle vane to said radially inward side.

18. The method of claim 12, wherein said turbine nozzle comprises a high pressure turbine nozzle.

19. The method of claim 12, wherein said step of depositing a first thermal barrier coating comprises depositing to a thickness of at least about 0.02 inches.

20. The method of claim 12, wherein said step of depositing a second thermal barrier coating comprises depositing to a thickness between about 0.02 inches and about 0.10 inches.

21. The method of claim 12, wherein first thermal barrier coating comprises yttria stabilized zirconia.

22. A method of modifying a flow area of a turbine nozzle through which a combustor gas flow passes, the method comprising the steps of:

providing a turbine nozzle having a thermal barrier coating deposited on at least one endwall; and machining said thermal barrier coating such that said nozzle flow area is increased.

23. The method of claim 22, wherein said at least one endwall comprises a segmented endwall.

24. The method of claim 22, wherein said thermal barrier coating comprises a tetragonal zirconia stabilized with about 7% to about 8% by weight yttria and said turbine nozzle comprises a high pressure turbine nozzle.

25. A method of modifying a flow area of a turbine nozzle through which a combustor gas flow passes, the method comprising the step of:

modifying a thermal barrier coating of at least one endwall of said turbine nozzle having a first nozzle flow area to form a second nozzle flow area.

26. The method of claim 25, further comprising the steps of:

evaluating a gas flow through said turbine nozzle; and machining said thermal barrier coating with diamond tooling.

27. The method of claim 25, wherein said turbine nozzle comprises a plurality of nozzle openings and said step of modifying provides a reduction in nozzle opening variation.

28. The method of claim 25, wherein said step of modifying comprises machining with borozon tooling.

29. The method of claim 25, wherein said step of modifying comprises machining with carbide tooling.

30. The method of claim 25, wherein said step of modifying comprises machining.

31. A method of modifying a flow area of a turbine nozzle through which a combustor gas flow passes, the method comprising the steps of:

depositing a first thermal barrier coating on a radially inward side of a nozzle outer endwall of said turbine nozzle, said step of depositing to a thickness between about 0.02 inches and about 0.10 inches, said thermal barrier coating selected from the group consisting of tetragonal zirconia stabilized with about 7% to about 8% by weight yttria and cubic zirconia stabilized with about 15% to about 30% by weight yttria;

depositing a second thermal barrier coating on a radially outward side of a nozzle inner endwall of said turbine nozzle, said step of depositing to a thickness between about 0.02 inches and about 0.10 inches, said thermal barrier coating selected from the group consisting of tetragonal zirconia stabilized with about 7% to about 8% by weight yttria and cubic zirconia stabilized with about 15% to about 30% by weight yttria;

brazing a radially outward end of at least one nozzle vane to said radially inward side;

brazing a radially inward end of at least one nozzle vane to said radially outward side; and machining said first thermal barrier coating and said second thermal barrier coating such that an increased nozzle flow area is produced.

32. A turbine nozzle for use in an engine, the turbine nozzle comprising:

a nozzle inner endwall;

a nozzle outer endwall positioned radially outward from said nozzle inner endwall, wherein at least one of said nozzle inner endwall and said nozzle outer endwall has a thermal barrier coating that has been machined to at least partially define a predetermined nozzle flow area of said turbine nozzle through which combustor gases pass, said predetermined nozzle flow area configured to provide a predetermined engine performance; and at least one nozzle vane positioned radially outward from said nozzle inner endwall and positioned radially inward from said nozzle outer endwall.

33. The turbine nozzle of claim 32, wherein said thermal barrier coating comprises a tetragonal zirconia stabilized with about 7% to about 8% by weight yttria.

34. The turbine nozzle of claim 32, wherein said thermal barrier coating comprises a cubic zirconia stabilized with about 15% to about 30% by weight yttria.

35. The turbine nozzle of claim 32, wherein a thickness of said thermal barrier coating is at least about 0.02 inches.

36. The turbine nozzle of claim 32, wherein said nozzle inner endwall, said nozzle outer endwall and said at least one nozzle vane comprise a material selected from the group consisting of nickel-base superalloy and cobalt-base superalloy.

37. The turbine nozzle of claim 32, wherein said nozzle inner endwall, said nozzle outer endwall and said at least one nozzle vane comprise structural ceramic.

38. The turbine nozzle of claim 32, wherein said nozzle inner endwall, said nozzle outer endwall and said at least one nozzle vane comprise a material selected from the group consisting of silicon nitride and silicon carbide.

* * * * *